US007308772B1

(12) United States Patent
Millett

(10) Patent No.: US 7,308,772 B1
(45) Date of Patent: Dec. 18, 2007

(54) ARTICULATED SIGHT MOUNT

(75) Inventor: James A. Millett, Huntington Beach, CA (US)

(73) Assignee: Millett Industries, Inc., Huntington Beach, CA (US)

( * ) Notice: Subject to any disclaimer, the term of this patent is extended or adjusted under 35 U.S.C. 154(b) by 122 days.

(21) Appl. No.: 11/291,550

(22) Filed: Dec. 2, 2005

(51) Int. Cl.
*F41G 1/387* (2006.01)

(52) U.S. Cl. ..... 42/127; 42/124

(58) Field of Classification Search ..... 42/124, 42/127, 148; 89/41.17
See application file for complete search history.

(56) References Cited

U.S. PATENT DOCUMENTS 3,405,448 A * 10/1968 Weatherby ..... 42/127
3,750,318 A * 8/1973 Burris ..... 42/127
3,877,166 A * 4/1975 Ward ..... 42/127
3,882,609 A * 5/1975 Troutman ..... 42/124
4,310,980 A * 1/1982 Pilkington ..... 42/127
4,383,371 A * 5/1983 Coffey ..... 42/124
4,799,325 A * 1/1989 Booze ..... 42/124
5,155,915 A * 10/1992 Repa ..... 42/127
5,680,725 A * 10/1997 Bell ..... 42/127
5,787,630 A * 8/1998 Martel ..... 42/125
6,295,754 B1 * 10/2001 Otteman et al. ..... 42/124
6,922,934 B1 * 8/2005 Huan ..... 42/127
2004/0139644 A1 * 7/2004 Murello ..... 42/85

* cited by examiner

*Primary Examiner*—Bret Hayes
(74) *Attorney, Agent, or Firm*—G. Donald Weber, Jr.

(57) ABSTRACT

A strong, yet easily detachable sight mount for use with various weapons such as rifles, shotguns and the like.

18 Claims, 1 Drawing Sheet

ARTICULATED SIGHT MOUNT

BACKGROUND

1. Field of the Invention

The invention is directed to a sight mount for weapons, in general, and to a quickly detachable, yet strongly clampable sight mount for weapons, in particular.

2. Background

There are many types of sight and/or scope mounts for weapons or other applications known in the art.

The known mounts include, primarily, two piece horizontally divided mounts and two piece vertically divided mounts.

In the horizontally divided mounts, the top section is attached to the bottom section by one or more screws to retain the scope or sight between the two sections. The bottom section includes an integral latch portion which is configured to engage one side of a support rail on a weapon and a separate latch portion which is adapted to selectively engage the opposite side of the support rail. The separate latch portion is adapted to be secured to the first latch portion by a manually adjusted set screw.

In the vertically divided mounts, the two sections retain the scope or sight therebetween and are joined together at the top and bottom by screws. Again, the bottom ends are configured to engage a support rail mounted on the weapon in that each bottom end includes a latching notch.

These mounts have been known for quite some time. They are, typically, made of durable plastic or a metal such as, but not limited to, aluminum, steel or the like.

However, both of these mounts are difficult to mount securely to the support rail. Also, they frequently need a separate tool or implement to adjust the locking screw at mounting end of the mount.

This latter requirement is especially cumbersome when the mount is being put in place and/or adjusted in the field while being utilized.

DESCRIPTION OF A PREFERRED EMBODIMENT

Figure 1:
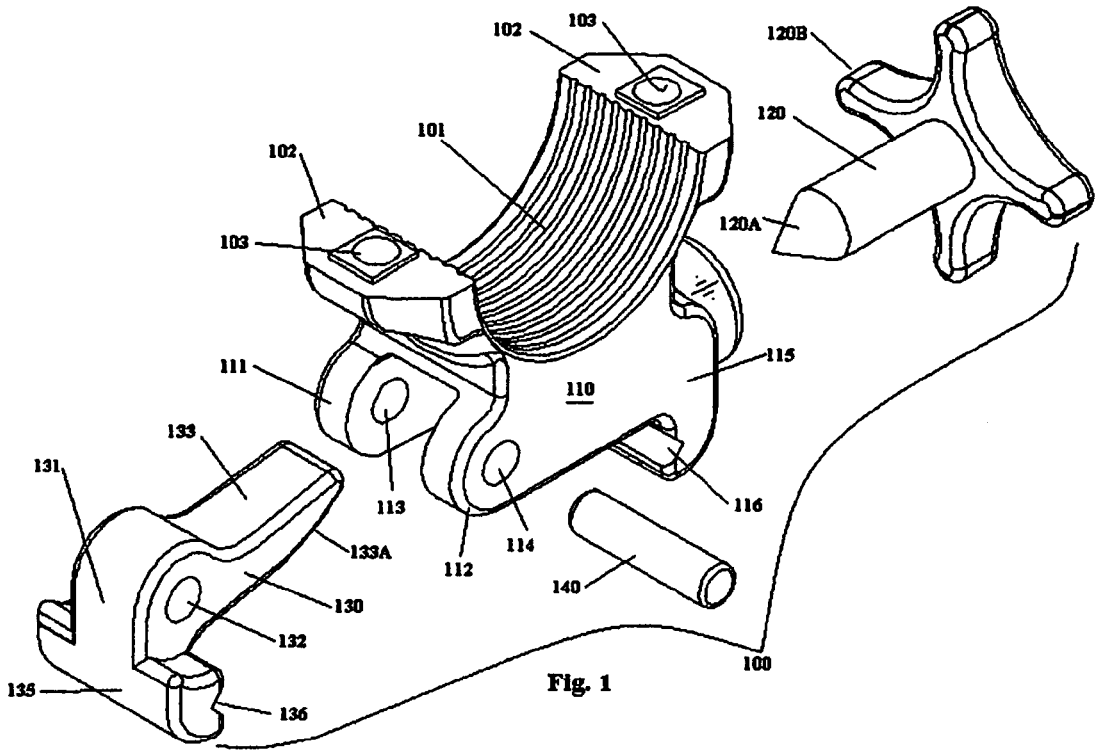
FIG. 1 is an exploded view of the base portion of a sight mount of the instant invention.

FIG. 1 is an exploded view of the base portion 100 of a sight mount. The base portion includes a saddle or cradle 101 in which the sight, scope or other apparatus is mounted. The cradle 101, typically, comprises a half-circle (180°) arc but other configurations are contemplated.

At each end of the cradle 101 is a connection lip 102. In the preferred embodiment, the lip 102 extends radially outwardly from the cradle 101 and includes an aperture 103 therein. Each lip 102 is intended to engage a counterpart lip in the upper portion (not seen) of the sight mount. The aperture 103 is intended to receive a suitable fastener (not shown) which also engages the upper portion of the sight mount whereby the upper and lower sight mount portions are securely connected together.

Preferably, the aperture 103 has a threaded interior surface to securely engage a screw threadedly coupled thereto via an aperture in the lip of the upper portion of the sight mount.

Alternatively, the aperture 103 may be a smooth bore in order to receive any fastener such as a screw, a pin, a rivet or the like.

In addition, it is contemplated that the lips of the sight mount portions can be interlocked or engaged in any other suitable configuration.

Disposed beneath the cradle 101 is a base 110 comprised of a pair of parallel sides 111 and 112 which extend downwardly from the bottom of the cradle.

At one end of each of the sides 111 and 112 is an aperture 113 and 114, respectively, which passes through the respective side.

The opposite ends of the sides 111 and 112 are joined to an end wall 115 which includes an aperture 216 therethrough (see infra) which communicates with the space between the side walls 111 and 112 under the cradle. The aperture 216 has a threaded inner surface.

In addition, the end wall 115 extends below both of the side walls and is configured to have a rail engaging notch 116 therein.

A threaded screw 120 is adapted to enter and engage the threaded aperture 216. The screw 120 has a tapered end 120A to provide a cam-surface as described infra. Also, the screw 120 has a relatively large end 120B which may have a knurled surface or any compliant shape for ease in grasping.

A pivotable cam 130 is provided to be attached to the base. The cam 130 includes a generally cylindrically shaped pivot body 131 with an aperture 132 axially therethrough. The aperture 132, typically, has a smooth inner surface.

Extending outwardly from one side of the pivot body 131 is a cam 133 which has a variable cam with a sloping surface 133A. In this embodiment, the sloping surface 133A is the underside of the cam 133.

Extending outwardly from another side of the pivot body 131 is a bottom ledge 135 which includes a rail engaging notch 136 which is the counterpart to notch 116 described supra. Thus, notch 136 is adapted to grasp the opposite side of a mounting rail on the weapon or the like.

Also, included in the mount 100 is a pin 140 which is, typically, a smooth surface rod. The pin 140 is inserted into and through the apertures 113 and 114 in the side walls 111 and 112, respectively, and also through the aperture 132 through the pivot body 131. Typically, the pin is inserted after the cam 130 has been placed between ends of the side walls 111 and 112 and beneath cradle 101. The pin 140 can engage either the side walls 111 and 112 or the cam 130 with a friction fit so long as the cam can rotate around the axis of pin 140 within the cradle base.

Figure 2:
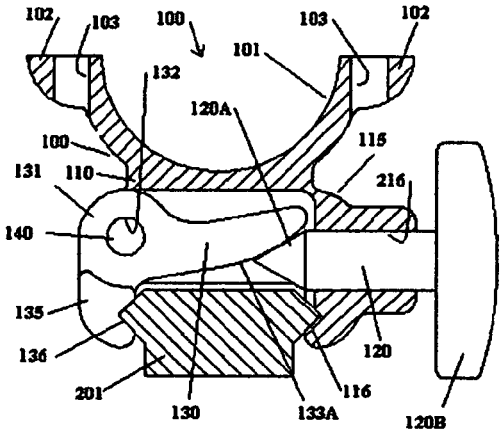
FIG. 2 is a cross-section of the sight mount portion of FIG. 1 shown in the assembled and locked position.
Figure 3:
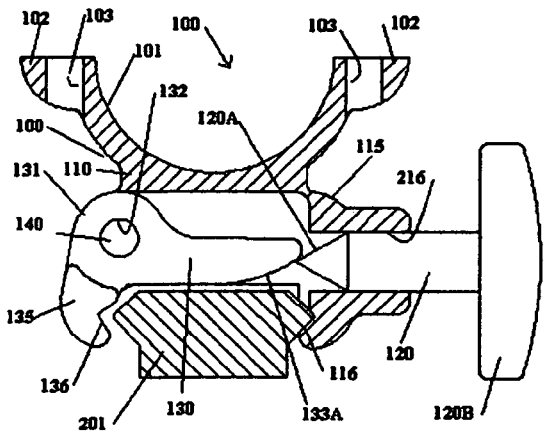
FIG. 3 is a cross-section of the sight mount portion of FIG. 1 shown in the assembled and unlocked position.

Referring now to FIGS. 2 and 3, there is shown a cross-section of a base portion 100 in the assembled state. Components which are similar in FIGS. 1, 2 and 3 have the same reference numerals.

In FIGS. 2 and 3, the base portion 100 includes the cradle 101 with the end lips 102 having apertures 103 passing therethrough. Base 110, including the space defined by the interior surfaces of side walls 111 and 112 as well as end wall 115, is formed at the bottom of cradle 101.

In FIGS. 2 and 3, the mounting rail 201 is shown in engagement with the notch 116 in end wall 115. The screw 120 is threadedly mounted in aperture 216 in end wall 115.

The pivot body 131 is mounted on pin 140 which passes through aperture 132 and is rotatably mounted in apertures 113 and 114 (see FIG. 1) for rotation about the axis of pin 140.

As shown in FIG. 2, the latched or locked position of base portion 100, screw 120 is threadedly inserted into the base 110. The shank of the screw is, thus, inserted into the space between the side walls 111 and 113. In this position, the tapered end 120A of screw 120 is forced into contact with the undersurface 133A of cam 133. This interaction forces the cam 133 upwardly so that the pivot body 131 rotates around the pin 140 (in this case counterclockwise) and pulls the bottom ledge 135 inwardly so that the notch 136 engages and encompasses the edge of rail 201.

As screw 120 is moved inwardly, and pivot body 130 rotates, the lip 135 tightly grasps the rail 201. In the unlikely event the grip becomes loose for any reason, the screw 120 can be further adjusted manually without any special tools or the like to re-establish the grip of the base portion 100 on the rail 201.

Conversely, as screw 120 is removed from the end wall, the force or pressure applied thereby to the undersurface 133A of cam 133 is reduced wherein pivot body 130 is free to rotate in the clockwise direction (in this example). As the pivot body 130 rotates, the ledge 135, with notch 136, is free to be displaced from the rail 201. When the ledge 135 and notch 136 are sufficiently removed or repositioned, the base portion 100 can be readily removed from the rail 201.

It is clear that base portion 100 as shown in FIG. 1, 2 or 3 is adapted to receive an upper part for retaining a sight or scope on the sight mount. The upper part of the complete sight mount can assume any conventional or specialized configuration desired so long as it mates with the attachment lips 102 of the mount of the instant invention.

Of course, the specific configuration of the saddle or cradle can be varied to any desired shape to support a sight, a scope of other accessory as desired.

Thus, there is shown and described a unique design and concept of a sight mount. While this description is directed to particular embodiments, it is understood that those skilled in the art may conceive modifications and/or variations to the specific embodiments shown and described herein. Any such modifications or variations which within the purview of this description are intended to be included therein as well. It is understood that the description herein is intended to be illustrative only and is not intended to be limitative. Rather, the scope of the invention described herein is limited only by the claims appended hereto.

The invention claimed is:

1. A support mechanism comprising, a cradle, a cradle support base, a first latch mechanism adjacent said cradle support base, an adjustable cam movably mounted to said cradle support base, a second latch mechanism adjacent said adjustable cam, and an adjustment screw threadedly engaged with said cradle support base and operable to move said adjustable cam and at least said second latch mechanism relative to said first latch mechanism.

2. The mechanism recited in claim 1 wherein, said cradle is integrally formed with said cradle support base.

3. The mechanism recited in claim 1 including, a pin which passes through said cradle support base and said adjustable cam.

4. The mechanism recited in claim 3 wherein, said pin engages at least one of said adjustable cam and said cradle support base in frictional fit.

5. The mechanism recited in claim 3 wherein, said adjustable cam rotates around the axis of said pin.

6. The mechanism recited in claim 1 wherein, said adjustable cam includes an angulated surface which is selectively engaged with at least a portion of said adjustment screw.

7. The mechanism recited in claim 6 wherein, said portion of said adjustment screw is angulated.

8. The mechanism recited in claim 1 wherein, said cradle is adapted to receive an upper support section.

9. The mechanism recited in claim 1 wherein, said adjustable cam extends under said cradle support base.

10. An articulated mounting mechanism for selective attachment to a support rail comprising, a cradle support, a first latch segment formed in said cradle support, an adjustable cam pivotally mounted to said cradle support, a second latch segment integrally formed with said adjustable cam, and an adjustment screw threadedly engaged with said cradle support and operable to move said adjustable cam and said second latch segment relative to said first latch segment.

11. The mechanism recited in claim 10 wherein, each of said first and second latch segments has a gripping surface.

12. The mechanism recited in claim 11 wherein, at least one of said first and second latch segments includes a notch in the gripping surface thereof.

13. The mechanism recited in claim 10 including, pin means for rotatingly supporting said adjustable cam in said cradle support.

14. The mechanism recited in claim 10 wherein, said adjustable cam includes a sloping surface for selectively engaging said adjustment screw.

15. The mechanism recited in claim 14 wherein, said adjustment screw includes an angulated end for selectively engaging said sloping surface of said adjustable cam.

16. A support mechanism comprising, a cradle, a cradle support base, a first latch mechanism adjacent said cradle support base, an adjustable cam movably mounted to said cradle support base, a second latch mechanism adjacent said adjustable cam, an adjustment screw threadedly engaged through said cradle support base, and a pin which passes through said adjustable cam and engages said cradle support base, said pin engages at least one of said adjustable cam and said cradle support base in a frictional fit, said adjustable cam includes an angulated planar surface which is selectively engaged with at least a portion of said adjustment screw so that said adjustment screw is operable to move said adjustable cam and at least said second latch mechanism relative to said first latch mechanism.

17. The mechanism recited in claim 16 wherein, each of said first and second latch segments has a gripping surface.

18. The mechanism recited in claim 17 wherein, at least one of said first and second latch segments includes a notch in the gripping surface thereof.

* * * * *